US007909104B2

(12) United States Patent
Bjørgum

(10) Patent No.: US 7,909,104 B2
(45) Date of Patent: Mar. 22, 2011

(54) SEALING DEVICE

(75) Inventor: Stig Ove Bjørgum, Voss (NO)

(73) Assignee: Bjorgum Mekaniske AS, Voss (NO)

( * ) Notice: Subject to any disclaimer, the term of this patent is extended or adjusted under 35 U.S.C. 154(b) by 190 days.

(21) Appl. No.: 12/294,043

(22) PCT Filed: Mar. 21, 2007

(86) PCT No.: PCT/NO2007/000110

§ 371 (c)(1),
(2), (4) Date: Sep. 23, 2008

(87) PCT Pub. No.: WO2007/108701

PCT Pub. Date: Sep. 27, 2007

(65) Prior Publication Data

US 2009/0101358 A1 Apr. 23, 2009

(30) Foreign Application Priority Data

Mar. 23, 2006 (NO) ..... 20061308

(51) Int. Cl.
*E21B 33/12* (2006.01)
*E21B 33/13* (2006.01)

(52) U.S. Cl. ..... 166/376; 166/192

(58) Field of Classification Search ..... 166/285, 166/292, 376, 192, 300, 122, 194, 288, 317
See application file for complete search history.

(56) References Cited

U.S. PATENT DOCUMENTS 5,607,017 A * 3/1997 Owens et al. ..... 166/288

FOREIGN PATENT DOCUMENTS

| | | |
|---|---|---|
| EP | 939194 | 9/1999 |
| EP | 1006258 | 6/2000 |
| WO | 2005049961 | 6/2005 |

* cited by examiner

*Primary Examiner* — Kenneth Thompson
*Assistant Examiner* — James G Sayre
(74) *Attorney, Agent, or Firm* — Christian D. Abel

(57) ABSTRACT

A decomposable sealing device is described for use in liquid-filled pipes or boreholes, which is characterised in that the sealing device comprises a sleeve-shaped element (19) which envelops a number of strata (5, 7, 9) completely or partly in the pipe's radial and a longitudinal direction, comprising layered division of a number of decomposable strata (5, 7, 9) and a number of closed liquid-filled chambers (16) arranged between the strata (5, 7, 9) and where the sleeve-shaped element (19) comprises a body (2) which can be rearranged to establish connection between the respective chambers (16) and one or more grooves (14) in the inner wall of a pipe. A method for decomposing the sealing device is also described.

13 Claims, 2 Drawing Sheets

SEALING DEVICE

BACKGROUND OF THE INVENTION

1. Field of the Invention

Figure 1A:
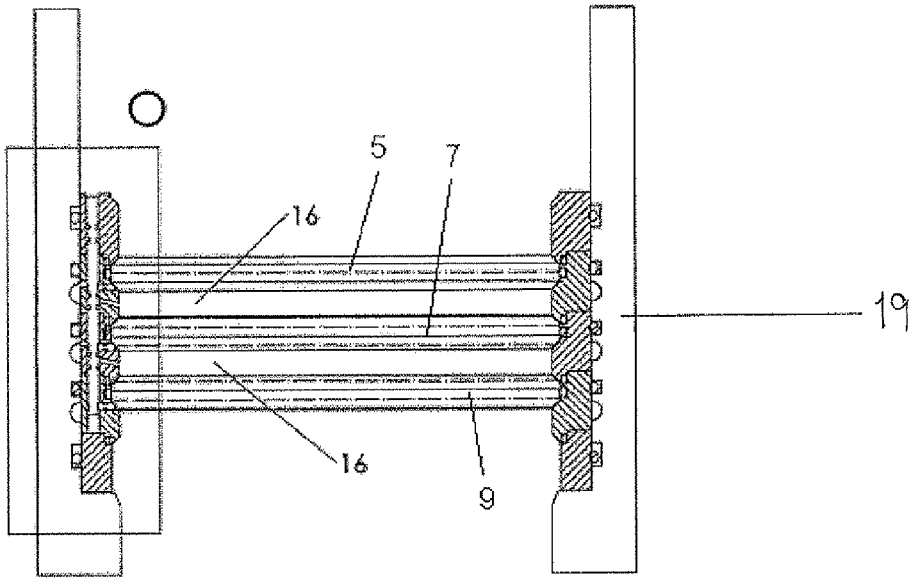

The present invention relates to a decomposable sealing device for use in pipes or boreholes, as well as a method related thereto.

2. Description of Related Art

It is well known within the oil industry that production wells have to be tested before being put into service. One of these tests involves checking whether the well can withstand the pressure at which it is to be operated during oil/gas production. If such a check is not carried out, there is a risk of fluids leaking out of the well during operation.

In order to conduct such tests, a plug device is placed down in the well to shut off the passage. A pressure is applied from the surface by means of a suitable fluid, and by checking the well over a period of time, it is possible to investigate whether the well is sufficiently leak-proof. The plug is normally mounted as a lower part of a production tubing, and lowered internally in a casing which is installed in the well beforehand.

Test plugs are placed in a specially adapted seat/housing in the tubing, and packer systems are normally employed in order to obtain an adequate seal against the surrounding inner wall of the tubing. The packers are located in a suitable groove in the inner tubing wall, forming a seal against the radially internally situated plug located in its seat.

In today's systems it is normal practice to employ test plugs which are decomposed by being blown up in the final phase of the tests in order to admit a free through-flow in the tubing.

The use of glass test plugs is well known, and this kind of material is considered highly suitable for the oil industry. It is practically inert with regard to all types of chemicals and is safe for the personnel who have to handle the plug. The glass, moreover, retains its strength at high temperatures, and it can stay in an oil well for a very long time without sustaining damage or breakdown.

The glass used in known plugs has undergone a hardening treatment, with the result that it is brittle on one side and on the other side it possesses the strength to resist the severe pressure stresses to which it is exposed.

In today's systems, a plug like that mentioned above is removed by means of an explosive charge, with the result that the glass is shattered into tiny particles, which are easily washed out of the well without leaving any potentially harmful residue. These explosive charges may be incorporated in the actual plug, or mounted outside the actual plug. The actual detonation is remotely controlled, and can be triggered from the surface of the well.

An example of a test plug made of glass, where the plug is arranged so as to be removable by means of an explosive charge, is known from NO B1 321976. The plug comprises a number of layered or stratiform ring discs of a given thickness, which are placed in abutment on top of one another. Between the different layers in the plug a shim film of plastic, felt or paper is inserted; the different glass layers may also be joined by lamination with an adhesive such as a glue. During use the plug will be mounted in a plug-receiving chamber in a pipe, where the underside of the plug rests in a seat at the bottom of the chamber.

The use is also known of solutions where the whole or parts of the plug are made of rubber, and where a section comprises a chemical which dissolves the rubber plug when the testing is completed and the plug requires to be removed. During operations from floating rigs, however, this method will be too slow and unreliable, in light of the operating costs for this kind of platform. In this case it will be impossible to predict the exact time when the plug is removed and the passage through the well opens.

The use of explosive charges for decomposing test plugs can provide a safe and calculable removal of the plug. However, in many countries extremely stringent requirements are placed on the use and import of explosives, and it is therefore desirable to provide a solution where the test plug can be removed in a controllable manner without the use of such means.

BRIEF SUMMARY OF THE INVENTION

It is therefore an object of the present invention to provide a plug device which can easily and safely be decomposed without the use of an explosive charge.

Thus an object of the present invention will be to provide a plug device which can withstand the high pressure to which it is exposed during testing. It is a further object to provide a plug device that gives a secure seal. Yet another object is to provide a plug device which is completely decomposed in the final phase of the test. A further object is to provide a plug device which can be decomposed by producing a pressure change internally in the plug device. It is a further object to provide a plug device which can easily be adapted to the conditions under which it is to be employed. It is also a wish to provide a plug device which attempts to avoid or at least diminish the disadvantages of existing plug devices.

These objects are achieved by a plug device according to the attached claims, where further details of the invention will be apparent from the following description.

A plug device according to the invention is particularly intended for use in connection with testing of production wells. The plug device comprises a sleeve-shaped element, where the sleeve-shaped element envelops a number of decomposable strata in a radial and a longitudinal direction of a pipe. The sleeve-shaped element may furthermore be composed of a number of annular supporting bodies arranged on top of one another, whereby these supporting bodies are so designed that two supporting bodies located on top of each other can receive a stratum, with the result that the stratum is kept in place by the interaction of the two supporting bodies. The plug device will thereby be composed of a first layer of supporting bodies, on which first layer a first stratum is placed, for example on a surface, whereupon a second layer of supporting bodies is arranged and a second glass stratum thereon, and so on. The plug device will thereby consist of alternate layers of supporting bodies and strata, whereby closed chambers are formed between the strata by means of this assembly. These chambers are filled with liquid, such as water, oil or another suitable liquid and the liquid in these chambers may be pressurised.

In an alternative embodiment the sleeve-shaped element may be in the form of a whole element, with graduated internal steps for abutment of the different strata.

The sleeve-shaped element may be placed in a housing, where the housing may further be placed internally in a production tubing or a casing. In another embodiment the housing may also form a part of a production tubing or as a third alternative the sleeve-shaped element may be employed without a surrounding housing. In this embodiment, however, the different parts must be connected in a suitable manner to prevent the plug from disintegrating.

It should be understood that the plug device according to the present invention may comprise any number of strata and supporting bodies, this number depending on the pressure, temperature, oscillations etc. to which the plug is to be exposed. The strata in the plug may also comprise other materials than glass, such as ceramic materials etc.

Another important aspect of the present invention is the properties of the glass, as it may be hardened, with the result that when it is point loaded it is so brittle that it crumbles up, while it should also be capable of resisting the pressure to which it is exposed. Moreover, the thickness of the glass must be adapted to the existing pressure conditions and the glass may also be surface ground, thereby forming a sealing connection with the supporting bodies.

The closed, liquid-filled chambers between the glass strata may initially be pressurised when the plug is assembled, but it will often be difficult to predict what the exact pressure in a well is. Thus in an alternative embodiment a spring bearing will be provided between the glass strata and the supporting bodies, thereby allowing the glass strata a certain movement in a longitudinal direction of the tubing. This will mean that when the plug device is exposed to a pressure in a tubing, the spring bearing will permit the glass strata and the liquid-filled chambers to be further compressed, thereby further increasing the pressure in the liquid-filled chambers.

The sleeve-shaped element also comprises a body, which for example may comprise at least one hydraulic slide valve, where the body may be rearranged to form a connection between the closed liquid-filled chambers and one or more grooves forming a relief chamber. The grooves must be filled with a compressible fluid, such as air, where the pressure in the grooves is advantageously around atmospheric pressure. Alternatively, the grooves may be provided with a vacuum. The grooves may be provided internally in the sleeve-shaped element, on the outside of the sleeve-shaped element, on the inside or outside of the housing, or internally in the housing, or also on the inside of the tubing that is to be sealed off by the plug device.

The groove may extend round the whole or parts of the circumference of the body on which it is arranged.

Between the body and one or more of the strata there will be mounted a number of pin devices, which are arranged to point load the strata when the plug device has to be decomposed.

When the plug has to be decomposed, the body will be moved relative to the sleeve-shaped element, by means of which movement a connection is established between the closed liquid-filled chambers and the grooves. This connection, which is a discharge duct, is provided in the supporting bodies. By means of an established connection, therefore, liquid from the liquid-filled chamber can flow out through the discharge duct into the grooves, since the pressure differences between the two chambers will be equalised. Since the strata are now no longer supported by the liquid in the liquid-filled chambers, by means of this action they can be exposed to a load that is sufficiently great to shatter them. In an embodiment, when an equalised pressure is obtained between the two chambers, the body may also be provided in such a manner that a pin device point loads the top stratum, with the result that, due to the pressure and the point loading to which it is exposed, the stratum is shattered. The pin device can be activated by the body being moved further downwards, thereby by means of this movement "pushing" the pin device out of its position into abutment against the glass stratum. The body may comprise at least one hydraulic slide valve, more preferred two slide valves, where one slide can be controlled in order to uncover the outlet channels, thereby establishing a connection between the liquid-filled chambers and the grooves, while the other slide valve can be used for controlling the movement of the pin devices. The activation of the two slide valves may be jointly controlled or it may be controlled separately. The body can thereby be operated in a controlled manner, with the result that the strata are decomposed, and where one can be sure that the entire plug device will be decomposed.

Thus by means of the present invention a plug device is provided which seals and absorbs the loads to which it is exposed in a more reliable manner than previously known solutions, where the plug device is not inadvertently decomposed, where one can determine exactly when the decomposition will occur and where the plug device provides far greater flexibility with regard to construction, use and safety.

Other advantages and special features of the present invention will become apparent from the following detailed description, the attached drawings and the following claims.

One advantage of the present invention is that the plug device according to the present invention can be decomposed in a controlled manner, with the result that the exact time can be determined for when free through-flow in the well can be expected to occur, without the use of explosives.

A BRIEF DESCRIPTION OF THE FIGURES

The invention will now be described in more detail with reference to the following figures, in which:

FIG. 1*a* is a cross section of the plug device in a closed position according to the present invention.

Figure 1B:
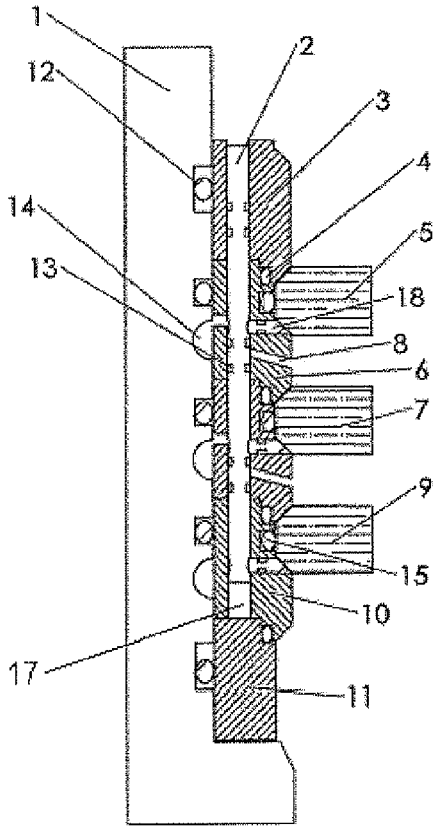

FIG. 1*b* is an enlarged view of a section of the plug device according to FIG. 1*a*.

Figure 2A:
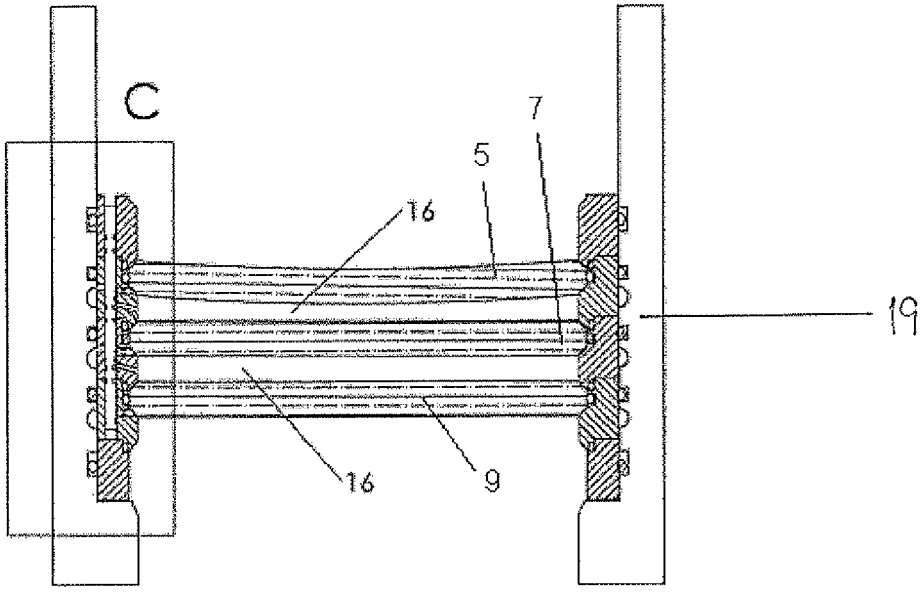

FIG. 2*a* is a cross section of the plug device in an open position according to the present invention.

Figure 2B:
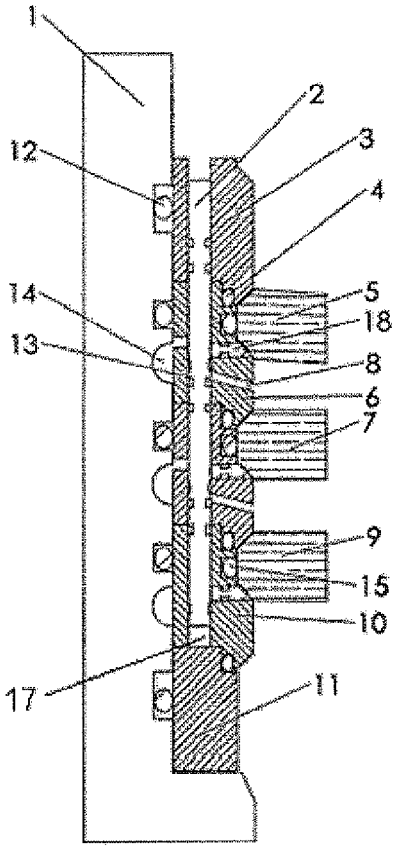

FIG. 2*b* is an enlarged view of a section of the plug device according to FIG. 2*a*.

DETAILED DESCRIPTION OF THE INVENTION

FIGS. 1*a* and 1*b* illustrate a cross section of the plug device according to the invention. The actual plug is mounted in a housing 1, which is a precise fit for the said plug. The plug comprises a number of strata, comprising layered division of material strata, such as glass, ceramics and the like, plus a number of cavities arranged between the said material strata. In the figure a plug device is illustrated comprising three material strata 5, 7 and 9 and two intermediate cavities 16, but it should be understood that the invention is not limited to this, but that a plug device is only described with a limited number of material strata in order to enhance the understanding of the invention's function. The invention can easily be modified to include additional material strata according to requirements, and is therefore not further described herein.

In the further description the material stratum is called a glass stratum, even though the invention is not limited thereto, but may comprise all types of material that are suited to the purpose of the invention, i.e. able to withstand the pressure that exists outside the plug device, which will typically be the well pressure, without breaking. The thickness of the stratum will also play an important part with regard to how great a pressure the glass strata can withstand before breaking.

The plug comprises a sleeve-shaped element 19, which in the exemplified figure comprises a number of supporting bodies 3, 6, 10, which are preferably annular and together envelop all the strata in the plug in the tubing's radial direction and longitudinal direction. In the exemplified FIGS. 1*a* and 1*b* the supporting body 3 will form an upper supporting body, and the supporting body 10 will form a lower supporting body. The remaining supporting bodies 6 are mounted between the upper supporting body 3 and the lower supporting body 10 in the tubing's longitudinal direction. The packer body 11 is mounted on the downside of the lower supporting body 10 in the tubing's longitudinal direction, in order to fit precisely into the plug device's housing 1.

FIG. 1*b* will now be described in greater detail. The glass strata 5, 7, 9 are arranged at a distance from one another. As mentioned earlier, a chamber 16, preferably a pressure support chamber, is provided between two adjacent glass strata. The number of chambers 16 may be filled with liquid, such as water, oil or another suitable liquid, and have a given pressure. It should be noted that the respective chambers may have different pressures in order to achieve the desired function for the device. It is advantageous if this chamber is filled with liquid before mounting the plug device in the production tubing. Between the said supporting bodies 3, 6, 10 a number of outlets 8 are provided, where each chamber 16 comprises at least one outlet 8 for discharge of the liquid from the chamber. The number of drainage outlets 8 are kept closed by means of a body 2, such as a hydraulic slide valve. The body is completely or partly incorporated in the supporting bodies 3, 6, 10.

Between the number of glass strata 5, 7, 9 and the respective supporting bodies 3, 6, 10, sealing bodies 15 are advantageously provided to prevent leakage between the chambers 16 in those areas where glass stratum and supporting body are adjacent to each other. Similarly, it is advantageous to provide sealing bodies 4 in the respective supporting bodies 3, 6, 10 to prevent leakage in those areas where the various supporting bodies 3, 6, 10 are adjacent to one another.

According to the above-mentioned embodiment, a cavity 17 will be provided in the body's 2 area of movement when the body is mounted in the plug device. This cavity 17 permits movement of the body 2 in the plug, and this movement triggers decomposition of the glass strata, which will be described in the following section. In the housing 1 there are mounted a number of grooves 14, which can hold the liquid discharged from the number of chambers 16 during the plug's decomposition phase. It is advantageous for the grooves 14 to have atmospheric pressure, thereby enabling the grooves to be filled with a compressible fluid, such as air. Above and below the respective grooves 14 in the housing's longitudinal direction, a number of sealing bodies, such as O-rings, are mounted in additional grooves in order either to prevent liquid from the well entering the plug device or to prevent the liquid from the respective drainage outlets 8 from coming into contact with other adjacent grooves 14.

The body 2 is equipped with a number of sealing bodies 13, such as an O-ring, which for example may be placed on the outside of the body to prevent liquid from the respective chambers 16 from being drained out of the outlets 8 when the plug device is in a closed position (rest position). It is advantageous for the said sealing bodies 13 to be mounted above and below the area where the drainage outlet 8 comes into contact with the body 2 in the body's longitudinal direction, in order to prevent liquid from the respective chambers/outlets from leaking out round the body 2.

The plug device goes from a closed (rest position) to an open position (activated position) by the body 2 being activated by an activation device (not shown). This device may be any kind of activation device which can be mounted in the vicinity of or adjacent to the plug device, and which can be controlled from an external source.

In order for the plug device to be activated, i.e. activate decomposition of the glass strata, the activation device provides at the desired time an increased pressure which is exerted against the body 2, thereby moving the body downwards a distance in the plug device, preferably a few millimetres, due to the pressure increase. The body will then be moved a sufficient distance to permit the sealing devices 13 which are mounted above and below the respective drainage outlets 8 to also be moved downwards, thereby opening the way for liquid from the respective chambers 16 to be taken out of the chambers and into the respective grooves 14.

Liquid from the respective chambers will automatically begin to leak out through the outlets 8 to the respective grooves 14 on account of the pressure difference between the chambers 16 and the grooves 14. When liquid from the first chamber, i.e. the chamber adjoining the glass stratum 5, which is located closest to the external environment (well environment), begins to leave the chamber and is discharged through its outlet 8 into its groove 14, a pressure change will occur in the chamber 16, which produces a pressure difference between the external environment and the pressure in the chamber. This will cause the glass stratum 5 to bend, as illustrated in FIG. 2*a*, and finally the stratum will break and be smashed into innumerable tiny particles. This is assuming that the pressure difference between the chamber 16 and the external pressure is greater than the pressure a glass stratum can tolerate. Fluid from the well bore will then be fed to the first chamber, thereby causing the next glass stratum 7 to be influenced by the same pressure forces With its movement, the body 2 has opened the way for drainage of all the chambers, with the result that the next glass stratum will also break due to the corresponding pressure difference between the external environment and the chamber below that abuts the second glass stratum 7. In this manner the layers will break and be decomposed one by one, and this will continue until all the glass strata in the plug device are decomposed, and the plug device admits free through-flow of the fluid in the well.

A further embodiment, which is also illustrated in FIGS. 1 and 2, is to mount a number of pin devices 18 between the said slide valve 2 and the respective glass strata. The pin 18 is arranged to generate point loading in the glass, in order to impair the strength of the glass stratum, thereby enabling decomposition to take place. It is advantageous for the respective pins 18 to be mounted in a groove in the outside of the body 2. In FIGS. 1 and 2 the pin 18 is illustrated in combination with the body 2, and functions in such a manner that when the body 2 is readjusted to activation position, i.e. moved inwards in the sleeve-shaped element 19, the number of pins 18 are pushed out of their respective grooves, and thereby pushed against the glass stratum, producing the point loading. It should be mentioned that the invention is not limited to this embodiment, but other embodiments that provide the same function may be employed, such as where the pin 18 constitutes a separate body, such as a slide valve.

During the decomposition of the glass strata, it may also happen that the last glass stratum 9 is not decomposed according to the above description, particularly if no pressure difference exists between the well pressure above the glass stratum and below the glass stratum. Pin device 18 will be able to provide a desired decomposition of this glass stratum. A pressure may also be applied from above the well in order to provide decomposition of the remaining glass stratum, thereby enabling the plug device to admit free through-flow of the fluid in the well.

An alternative embodiment of the present invention may be for the plug device to be constructed without the sealing devices 12, with the result that when the body 2 is rearranged, well fluid is supplied up to the plug from below, and in this embodiment the lower glass stratum 9 will be decomposed first, continuously followed by the other glass strata.

The invention claimed is:

1. A decomposable sealing device for use in pipes or boreholes, wherein the sealing device comprises a sleeve-shaped element which envelops a number of decomposable strata at least partly in a radial and a longitudinal direction of a pipe, arranged so as to form a number of closed liquid-filled chambers between the strata and where the sleeve-shaped element comprises a body which can be rearranged to establish connection between the respective chambers and one or more grooves that form a relief chamber.

2. A device according to claim 1, wherein the device comprises a number of pin devices which are mounted between the body and one or more of the decomposable strata arranged to point load the strata when the body is rearranged.

3. A device according to claim 2, wherein at least approximately the whole volume in the respective chambers comprises liquid.

4. A device according to claim 1, wherein the number of decomposable strata is selected from the material group glass or ceramics.

5. A device according to claim 2, wherein the body comprises at least one hydraulic slide valve.

6. A device according to claim 1, wherein a housing arranged round the sleeve-shaped element comprises at least one groove for each chamber.

7. A device according to claim 6, wherein the connection between the respective chambers and one or more grooves comprises an outlet channel.

8. A device according to claim 1, wherein the sleeve-shaped element comprises a number of annular supporting bodies.

9. A device according to either of claims 2 or 7, wherein the body comprises a number of sealing bodies which are mounted on the outside of the body, preferably above and below the respective areas where one end of the respective outlets abuts the body.

10. A device according to claim 8, wherein a number of sealing bodies are mounted between one or more of the supporting bodies and the housing.

11. A method for decomposing a sealing device mounted in a pipe or borehole, the method comprising the steps of:

(a) employing a sealing device comprising a sleeve-shaped element which envelops a number of decomposable strata at least partly in a radial and a longitudinal direction of a pipe, the sealing device being arranged so as to form a number of closed liquid-filled pressure chambers between the strata, and where the sleeve-shaped element comprises a body, the body being capable of being rearranged so that liquid from the respective chambers can be introduced into one or more grooves, the one or more grooves providing at least one relief chamber, (b) rearranging the body in order to generate a pressure reduction in the respective chambers, whereby said pressure reduction bends and breaks the surfaces of the strata disintegrating the sealing device.

12. A method according to claim 11, wherein:

a number of pin devices, are mounted between the body and one or more of the decomposable strata said pins providing point loading of the strata when the body is rearranged.

13. A method according to claim 12, the method comprising the step of:

decomposing the decomposable strata at different times in a continuous sequence.

* * * * *